US005146704A

United States Patent [19]

Dugan

[11] Patent Number: 5,146,704

[45] Date of Patent: Sep. 15, 1992

[54] ILLUMINATED SIGN

[76] Inventor: Billy G. Dugan, 5855 Brookwood Rd., Indianapolis, Ind. 46226

[21] Appl. No.: 678,758

[22] Filed: Apr. 1, 1991

[51] Int. Cl.[5] ..... G09F 13/00

[52] U.S. Cl. ..... 40/552; 40/564; 40/574

[58] Field of Search ..... 40/552, 564, 574, 540, 40/605

[56] References Cited

U.S. PATENT DOCUMENTS

| | | | |
|---|---|---|---|
| 769,457 | 9/1904 | Auzeric | 40/552 |
| 2,276,856 | 3/1942 | Mulberger | 362/812 X |
| 2,850,823 | 9/1958 | Sauer | 40/541 |
| 2,923,080 | 2/1960 | Spangler | 40/552 |
| 3,566,525 | 3/1971 | Nassil et al. | 40/552 |
| 3,755,943 | 9/1973 | Cesarott | 40/552 |
| 3,968,584 | 7/1976 | Kingston | 362/812 X |
| 4,097,632 | 6/1978 | Minogue et al. | 362/812 X |
| 4,532,579 | 7/1985 | Merryman | 40/552 X |
| 4,553,345 | 11/1985 | Bercier et al. | 40/564 X |
| 4,891,896 | 1/1990 | Boren | 40/552 X |
| 4,970,816 | 11/1990 | Trame | 40/552 |

FOREIGN PATENT DOCUMENTS

| | | | |
|---|---|---|---|
| 577194 | 5/1958 | Italy | 40/552 |

*Primary Examiner*—James R. Brittain
*Assistant Examiner*—Milton Nelson, Jr.
*Attorney, Agent, or Firm*—Harness, Dickey & Pierce

[57] ABSTRACT

Disclosed is an illuminated sign incorporating an enclosure to give the sign a three-dimensional perspective. A front panel of the enclosure includes a plurality of individual embossed characters which are translucent to light. The remaining portion of the front panel is opaque to light such that an illumination source within the enclosure only shines through the characters on the front panel of the sign. The front panel is spaced from a back panel by a side panel to form the enclosure. The front and back panels substantially follow the contour of each individual character except for a middle supporting portion such that it appears that each character is illuminated by a separate light source and that each character is spatially separate and distinct from each adjacent character.

9 Claims, 2 Drawing Sheets

ILLUMINATED SIGN

BACKGROUND OF THE INVENTION

1. Field of the Invention

This invention discloses generally an illuminated sign, and more specifically, an illuminated sign incorporating a plurality of characters on a single sign enclosure having the appearance of separate three-dimensional characters.

2. Discussion of the Related Art

A sign is intended to generate certain information in the mind of a sign viewer. The value of a particular sign can, however, extend beyond the words or images the sign was intended to convey. A sign can have value by the manner in which it portrays certain information, and the extent to which it creates an overall favorable impression on the sign viewer. If a sign is of high quality a person is more likely to remember it, and also associate that which the sign was intended to portray as being of high quality. Therefore, the image that a sign creates regarding a certain business or product can be enhanced by the manner in which the sign is perceived by the sign viewer.

From an aesthetic point of view, it is generally accepted that a three-dimensional illuminated sign in which the individual characters are separate and distinct from each other, and have their own individual lighting systems, appears as a high quality sign. However, such an illuminated sign is exceedingly expensive to produce due to not only the increased material and fabrication cost of the actual characters themselves, but also the self-contained sets of hardware necessary for each of the individual light sources of each of the characters. Further disadvantages include the cumbersomeness of handling the individual characters, and the obvious problems of having to align with precision separate individual characters when mounting the sign. Furthermore, with a plurality of individual light sources, such a sign possesses increased probability of a burned-out light source, thus increasing the cost of operating the sign.

It is therefore an object of the present invention to provide a three-dimensional illuminated sign providing the high quality aesthetically pleasing look of a sign having individual letters with individual light sources, and still maintain the cost effectiveness of a single sign having multiple characters on a single display surface.

SUMMARY OF THE INVENTION

Disclosed is a three-dimensional, illuminated sign having the appearance of individual characters incorporating individual illumination sources, but in which all of the characters are supported on a single display surface. A back panel, side panel and front panel combine to form an enclosure which houses an illumination source. The front panel or display surface includes a series of embossed characters or an embossed design. The side panel and back panel are generally constructed of a substantially opaque material, while the embossed characters on the front panel are constructed of a translucent material. For ease of manufacture, the entire front panel may be constructed of a translucent material and the non-embossed portions painted with an opaque paint or other coating to provide the required differentiation. The contours of the front and back panels are such that they generally follow the contours of the plurality of individual characters, except for a middle support portion. The side panel is dimensioned to separate the back and front panels by an appropriate distance, thereby giving the characters individual three-dimensional configurations. Accordingly, the sign has the appearance that each character is separate and distinct from its adjacent characters, and that each character has its own individual light source. By this design, the cost and maintenance of a single display surface sign is realized, but the perception of a sign having a plurality of individual separate characters is achieved.

Additional objects, advantages, and features of the present invention will become apparent from the following description and appended claims, taken in conjunction with the accompanying drawings.

DETAILED DESCRIPTION OF THE PREFERRED EMBODIMENTS

The following description of the preferred embodiment of the present invention is merely exemplary in nature and is in no manner intended to limit the invention or its application or uses.

Figure 1:
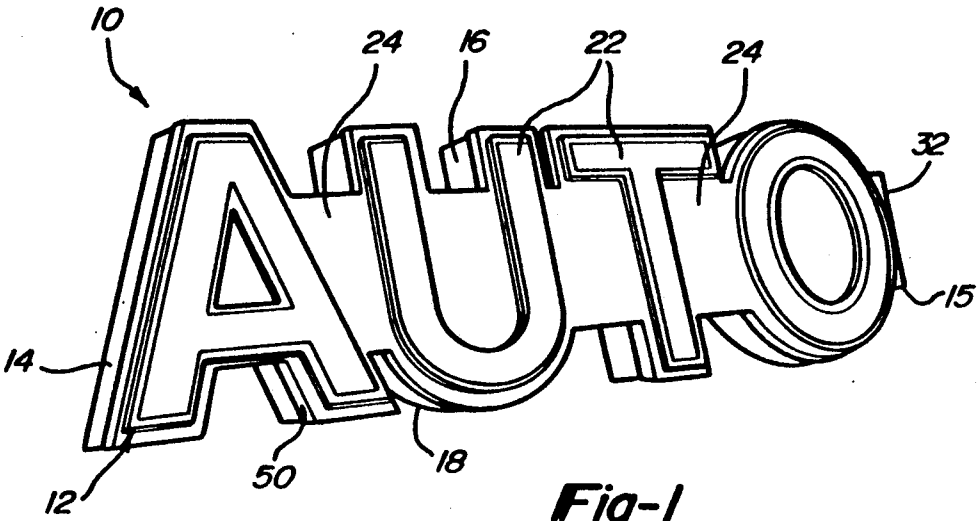
FIG. 1 is a perspective view of an illuminated sign according to a preferred embodiment of the present invention.

FIG. 1 is a perspective view of an illuminated sign, shown generally at 10, according to a preferred embodiment of the present invention. Illuminated sign 10 includes a front panel 12, side panels 14 and 15, a top panel 16, a bottom panel 18 and a back panel 20 (Also see FIG. 3). Panels 12, 14, 15, 16, 18 and 20 comprise the walls which form sign 10 as a hollow enclosure. Front panel 12 includes a peripheral lip portion 50 which runs substantially perpendicular to the face of front panel 12 completely around its edge, and adjacent to side panels 14 and 15, top panel 16 and bottom panel 18, as shown in FIG. 1. Side panels 14 and 15, top panel 16 and bottom panel 18 may be formed of a single piece of material or may be separate sections joined together by appropriate means. Embossed on front panel 12 are a plurality of characters 22. The embossed characters 22 are raised outwardly on front panel 12 a predetermined amount, and are generally of a different color than the remaining portions of front panel 12. In the embodiment illustrated, characters 22 are letters which spell out the word "AUTO". It will be understood, however, that characters 22 can be of any pattern or design.

Within the enclosure created by the panels as described above, is an illumination source 42 (see FIG. 3). Generally, side panels 14 and 15, bottom panel 18, back panel 20 and top panel 16 will be a substantially opaque material, such as aluminum or an opaque plastic, and front panel 12 will be a translucent material, such as an appropriate plastic or the like. Opaque paints can be used to highlight translucent characters 22 and render the remaining portions of front panel 12 opaque. Therefore, upon illumination of light source 42, only characters 22 will appear to be illuminated.

As can be seen from FIG. 1, each embossed character 22 has a certain outer perimeter configuration or shape.

Front panel 12 is configured such that a substantial portion of its outer edge or periphery follows the outer shape of each of the characters 22. Top panel 16 and bottom panel 18 are also configured to follow the outer contours of each character along the perimeter of front panel 12, substantially at a right angle to front panel 12. Further, side panels 14 and 15 generally follow the outer contour of characters 22 at each end of sign 10. At one end of sign 10, side panel 15 is provided with a flat portion 32 for joining additional signs to sign 10 which will be described hereunder. Thus, side panels 14 and 15, top panel 16 and bottom panel 18 are continuous and substantially follow the outer perimeters of characters 22. The outer edge of front panel 12, as well as the top, bottom and side panels 16, 18, 14 and 15 do not follow the contours of the outer perimeter of each of the individual characters 22 completely because sign 10 also incorporates a connecting portion such that each character 22 is part of a common backing, here front panel 12. Therefore, a middle connecting portion 24 of front panel 12 does not follow the contours of the outer perimeter of each of the characters 22, but instead forms the connection between each character 22. Back panel 20 is of substantially the same overall shape as front panel 12.

The incorporation of spacing between front and back panels 12 and 20 by side panels 14 and 15, top panel 16, and bottom panel 18, as described above, gives illuminated sign 10 depth, as well as forming an enclosure for the illumination source 42. Since side panels 14 and 15, and top and bottom panels 16 and 18 follow the outer perimeter of front panel 12, the appearance is given that each character 22 is separate and distinct from every other character 20, thereby giving each character 22 a three-dimensional "can" effect. Consequently, each individual character 22 has the appearance of having its own light source within separate enclosures, and thus the desirable "look" of a higher quality and more expensive sign. The width of middle connecting portion 24 is such that adequate support is given to the sign 10, while still maintaining the overall appearance that each individual character 22 is separate in space.

Figure 2:
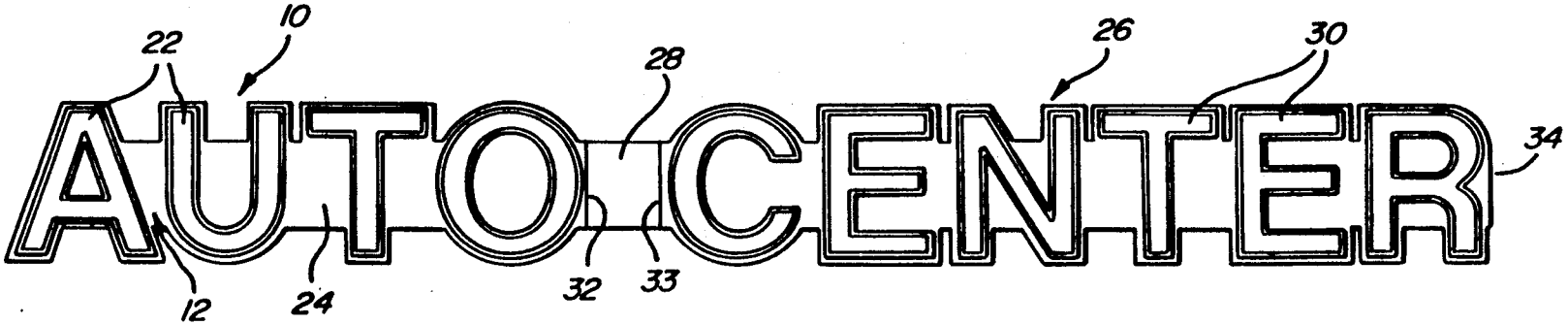
FIG. 2 is a front view of an illuminated sign according to a preferred embodiment of the present invention.

FIG. 2 shows a front view of an illuminated sign according to a preferred embodiment of the present invention in which the illuminated sign 10 of FIG. 1 is connected to a second illuminated sign 26 by means of a non-illuminated optional spacer portion 28. Illuminated sign 26 also includes a plurality of embossed characters 30, in this case spelling out the word "CENTER". Illuminated sign 26 has the same configuration as described above for sign 10 to provide the appearance of individual characters having individual light sources. Specifically, sign 26 includes appropriate panels as described above for sign 10 to form a single enclosure housing an illumination source for simultaneously illuminating each character 30. As with sign 10, the panels of sign 26 substantially follow the outer perimeters of each character 30.

Optional spacer portion 28 is of the same substantial height as the connecting portion 24 between the individual characters 22, and has a width which is arbitrary depending on the distance desired between sign 10 and sign 26. In addition, spacer portion 28 has a depth substantially equal to the distance between back panel 20 and front panel 12. The side panels at each end of sign 26 have flat end portions 33 and 34, substantially identical to flat portion 32 of sign 10. Nonilluminated spacer portion 28 has flat portions on either end to conform with flat portions 32 and 33 of signs 10 and 26, respectively. Means (not shown) to rigidly connect the flat end portions of spacer portion 28 to the flat end portions 32 and 33 by an easily removable connection are included, and may constitute any appropriate joining mechanism known to those skilled in the art. At the opposite end of sign 26 from flat portion 33, flat portion 34 is positioned such that yet another sign can be removably attached to sign 26. The use of spacer 28 is entirely optional, as FIG. 2 illustrates, the ending letter of sign 10 and the beginning letter of sign 26 have the aesthetic characteristics of individual letters regardless of whether spacer 28 is utilized.

Figure 3:
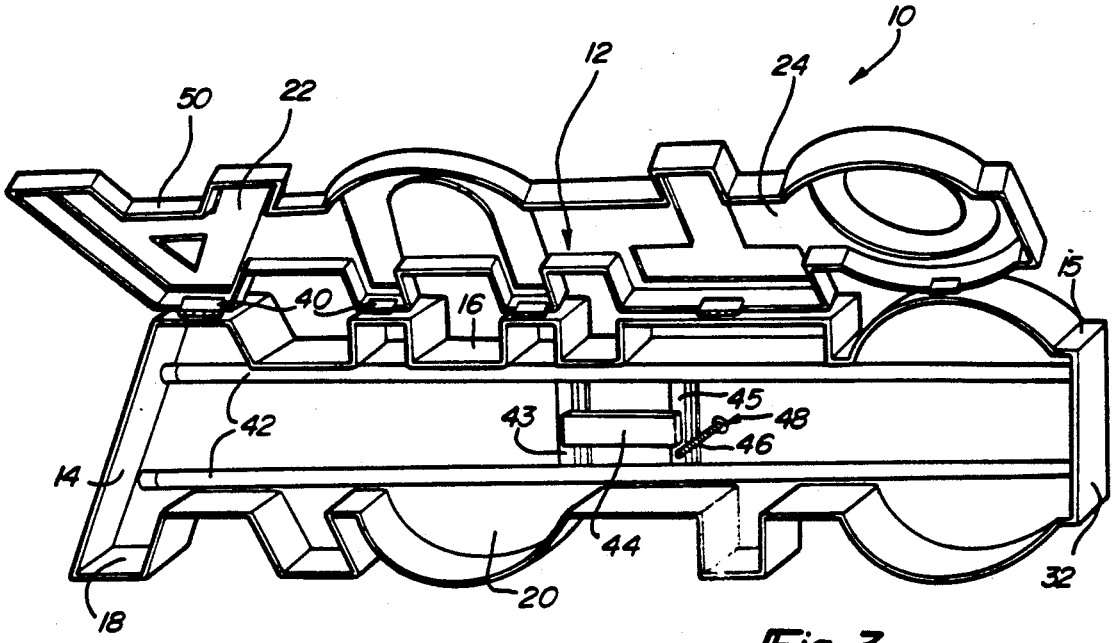
FIG. 3 is a perspective view of the inside of the sign according to the preferred embodiment of FIG. 1.

Now turning to FIG. 3, a perspective view of the inside of the enclosure formed by panels 12, 14, 15, 16, 18 and 20 is shown for illuminated sign 10. As can be seen, front panel 12 is attached to top panel 16 by means of hinges 40. In this embodiment, a hinge is provided at each position where top panel 16 extends to its greatest height, i.e. substantially at the top portion of each character 22. Hinges 40 are connected to front panel 12 at lip portion 50. Therefore, front panel 12 can be readily and easily pivoted away from back panel 20, as well as side panels 14 and 15, and top and bottom panels 16 and 18, to expose the internal portion of the enclosure.

As shown in FIG. 3, front panel 12 may be pivoted at an angle substantially between 90° and 180° with respect to back panel 20. From this view it can be seen that back panel 20 follows substantially the same overall configuration as front panel 12 to provide the appearance of individual separate characters 22. Peripheral lip portion 50 is formed substantially at a right angle to front panel 12 and completely encircles the edge of front panel 12 to assist closure of front panel 12 with respect to panels 19, 15, 16 and 18, as shown in FIG. 1, without loss of illumination. While lip portion 50 is adjacent to the outside of side panels 14 and 15, top panel 16 and bottom panel 18 when front panel 12 is closed, and therefore, front panel 12 is slightly larger than back panel 20, it will be understood that other methods can be used to form and provide access to the enclosure. It may be desirable, for instance, in certain situations to permanently seal the front of the enclosure and provide other means of access to it. It may also be desirable to secure front panel 12 to panels 14, 15, 16, and 18 with conventional fasteners such as screws or the like, through lip portion 50, thereby eliminating hinges 40.

Positioned within the enclosure of the preferred embodiment are two florescent light tubes 42. Light tubes 42 are supported at their ends on back panel 20 by known means, and generally run the entire length of sign 10 such that each individual character 22 is illuminated substantially equally. Light tubes 42 are generally positioned along middle portion 24 within the enclosure. Of course, a fewer or greater number of tubes, or other illumination means, could be used instead of the light tubes 42. It is anticipated that the size and design requirements of each individual sign will determine the appropriate illumination sources.

Positioned on back panel 20 is a ballast 44 for supplying power to the florescent tubes 42. Ballast 44 is supported on back panel 20 at each of its ends by support structures 43 and 45. To bring power to the ballast 44 an electrical cable 46 is brought through a hole 48 in back panel 20 and connected to ballast 44. The other end of cable 46 is connected to an appropriate power supply.

Other appropriate means could also be used to bring power to the light source within the enclosure.

Figure 4:
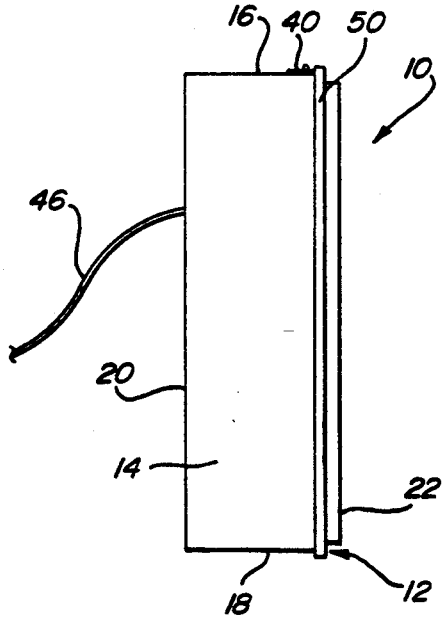
FIG. 4 is an end view of the illuminated sign of FIG. 1.

Now turning to FIG. 4, an end view of sign 10 in a closed position is shown. Specifically illustrated therein are side panel 14, front panel 12, and back panel 20. An embossed character 22 is shown positioned on front panel 12. Lip portion 50 is shown positioned over part of top panel 16 and bottom panel 18, as well as side panel 14. In addition, one hinge 40 is shown on top panel 16. Hinge 40 is rigidly affixed to the top surface of top panel 16 and the bottom or inside surface of lip portion 50. Cable 46 is seen extending out of back panel 20.

In a specific embodiment of illuminated sign 10 described above, front panel 12 is an appropriately configured sheet of 0.125 inch thick translucent LEXANT TM having embossed characters 22. Characters 22 are embossed on the sheet by known means. Each of the embossed characters 22 is approximately 24 inches high. Front panel 12 is painted with a grip flex paint such that the embossed characters remain translucent of a desired color, and the remainder of front panel 12 becomes opaque and of another color. Spacer portion 28 of FIG. 2 is approximately 12 inches wide and 14 inches high. Accordingly, middle portion 24 is also approximately 14 inches high. Illuminated sign 10 itself is approximately 7' 10" inches long. Back panel 20, top panel 16, bottom panel 18 and side panels 14 and 15 are generally made of aluminum. Back panel 20 is approximately 0.080 inches thick, whereas top panel 16, bottom panel and side panels 14 and 15 are approximately 0.040 inches thick. In addition, side panels 14 and 15, top panel 16 and bottom panel 18 have a width of approximately 6 inches giving illuminated sign 10 its depth. Top panel 16, bottom panel 18 and side panels 14 and 15 are preferably formed of a single piece of aluminum which is bent into the appropriate peripheral configuration. Of course, a plurality of substantially identical width pieces can be used and affixed together in an appropriate manner known to those skilled in the art. Back panel 20 is rigidly or permanently affixed to side panels 14 and 15, top panel 16 and bottom panel 18 by tacking, welding or other suitable means. The preferred embodiments described above disclose that front panel 12 can be hinged to top panel 16. However, front panel 12 can be affixed to either of side panels 14 and 15, top panel 16 and/or bottom panel 18 by appropriate means known to those skilled in the art.

The foregoing discussion discloses and describes merely exemplary embodiments of the present invention. One skilled in the art will readily recognize from such discussion, and from the accompanying drawings and claims, how various changes, modifications and variations can be made therein without departing from the spirit and scope of the invention as defined in the following claims.

What is claimed is:

1. A sign comprising:

a sign back panel cut out into a predetermined shape and formed of a single piece, said sign back panel being opaque;

a sign front panel cut out into substantially the same shape as the back panel, said sign front panel formed of a single piece and including at least two separate characters of a word or phrase embossed on said front panel, the embossed characters defining outer perimeter contours, wherein the cut out shape of the front panel and the back panel substantially follow the contours of the at least two characters except for a middle portion wherein each contoured character cut out of the front panel has an uppermost edge, and wherein the embossed characters are translucent and the middle portion of the front panel is opaque;

a sign side panel connected to and separating the sign back panel and the sign front panel such that the combination of the sign side panel, sign back panel and sign front panel form a single sign enclosure, wherein the sign side panel includes an uppermost edge for each character corresponding to the uppermost edges of the front panel; and closure means comprising a hinge connected between substantially each corresponding uppermost edge whereby access is provided to said enclosure.

2. The sign of claim 1 further comprises a non-illuminated spacer portion means to connect said sign to another sign.

3. The sign according to claim 1 wherein said sign side panel and said sign back panel are aluminum, and said sign front panel is plastic.

4. The sign of claim 1 further comprising illumination means positioned within said single sign enclosure, said illumination means illuminating each of said at least two characters.

5. The sign of claim 4 wherein said illumination means comprises at least one fluorescent lamp.

6. An illuminated sign comprising:

a substantially planar sign back panel cut out into a predetermined shape and formed of a single piece, said sign back panel being opaque;

a sign front panel cut out into substantially the same shape as the back panel, said sign front panel formed of a single piece and including at least two separate characters of a word or phrase embossed on said front panel, the embossed characters defining outer perimeter contours, wherein the cut out shape of the front panel and the back panel substantially follow the contours of the at least two characters except for a middle portion, wherein each contoured character cut out of the front panel has an uppermost edge, and wherein the embossed characters are translucent and the middle portion of the front panel is opaque;

a single piece sign side panel connected to and separating the sign back panel and the sign front panel such that the combination of the sign side panel, sign back panel and sign front panel form a three-piece single sign enclosure, wherein the sign side panel includes an uppermost edge for each character corresponding to the uppermost edges of the front panel;

closure means for providing access to said enclosure comprising a hinge connected between substantially each corresponding uppermost edge; and illumination means positioned within said sign enclosure, said illumination means providing illumination for each of said at least two characters.

7. The illuminated sign of claim 6 wherein said illumination means is at least one fluorescent lamp.

8. The illuminated sign of claim 6 wherein said side panel includes means to connect said sign to another sign.

9. The illuminate sign according to claim 6 wherein said back panel and said side panel are constructed of aluminum sheet metal and said front panel is constructed of a plastic material.

* * * * *